US010223961B2

(12) United States Patent
Segura Puchades

(10) Patent No.: US 10,223,961 B2
(45) Date of Patent: Mar. 5, 2019

(54) METHOD FOR DISPLAYING IMAGES ON A MATRIX SCREEN

(71) Applicant: COMMISSARIAT A L'ENERGIE ATOMIQUE ET AUX ENERGIES ALTERNATIVES, Paris (FR)

(72) Inventor: Josep Segura Puchades, Fontaine (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 12 days.

(21) Appl. No.: 15/094,600

(22) Filed: Apr. 8, 2016

(65) Prior Publication Data

US 2016/0300525 A1 Oct. 13, 2016

(30) Foreign Application Priority Data

Apr. 10, 2015 (FR) ..... 15 53140

(51) Int. Cl.

| | |
|---|---|
| ***G09G 3/30*** | (2006.01) |
| ***G09G 3/32*** | (2016.01) |
| ***G09G 3/20*** | (2006.01) |
| ***G09G 3/3233*** | (2016.01) |

(52) U.S. Cl.

CPC ..... *G09G 3/32* (2013.01); *G09G 3/20* (2013.01); *G09G 3/2022* (2013.01); *G09G 3/2092* (2013.01); *G09G 3/3233* (2013.01); *G09G 2300/0842* (2013.01); *G09G 2300/0857* (2013.01); *G09G 2310/0224* (2013.01); *G09G 2320/0252* (2013.01)

(58) Field of Classification Search

CPC ..... G09G 3/32; G09G 3/2092; G09G 3/2022; G09G 3/20; G09G 3/3233; G09G 2320/0252; G09G 2310/0224; G09G 2300/0857; G09G 2300/0842

See application file for complete search history.

(56) References Cited

U.S. PATENT DOCUMENTS

2003/0011314 A1* 1/2003 Numao ..... G09G 3/3233 315/169.3

2009/0058769 A1 3/2009 Kawabe

* cited by examiner

*Primary Examiner* — Hau H Nguyen

(74) *Attorney, Agent, or Firm* — Baker & Hostetler LLP

(57) ABSTRACT

A method for displaying images on an active matrix screen, i representing a pointer of a current row and each pixel comprising a memory and a display component comprises controlling the brightness of the pixels by a binary word comprising a number of bits written successively into the memory and by controlling the display component as a function of a state of the bit written into the memory, the bits of each binary word being ranked by their weight from j=1 to j=P. The writes are sequenced: from a current row i, writing on the rows $i+2^j$, from j=1 to j=P, the bit of weight j of each binary word associated with different pixels of rows $i+2^j$; repeating, $2^P-1$ times, the writes mentioned above by shifting the pointer i of the current row by one unit on each repetition; i being determined modulo $2^P-1$ to lie between 1 and 2P−1.

10 Claims, 15 Drawing Sheets

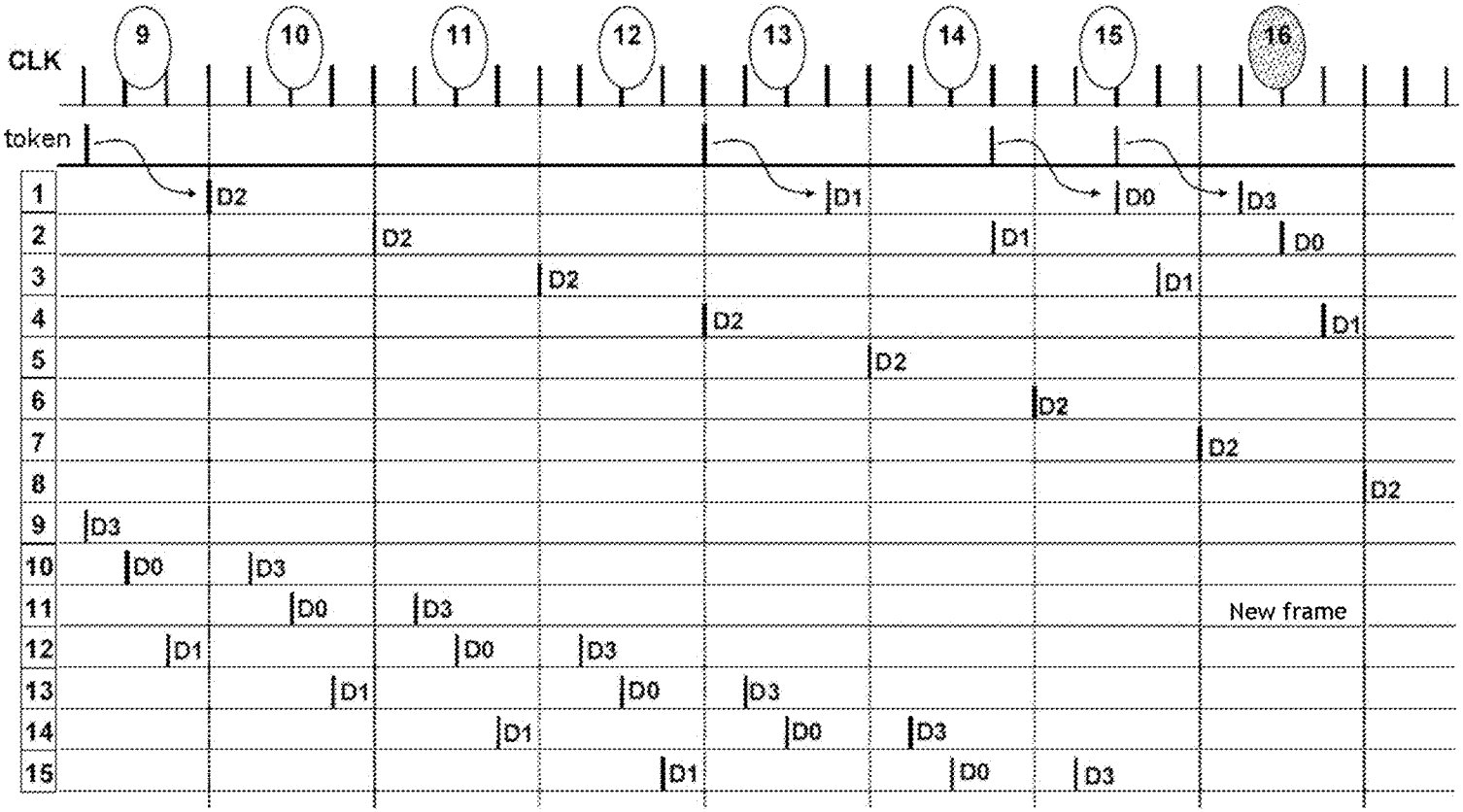
CLK
token
9
10
11
12
13
14
15
16
1
2
3
4
5
6
7
8
9
10
11
12
13
14
15
D2
D3
D0
D1
D2
D1
D0
D3
D2
D1
D2
D2
D3
D0
D1
D3
D0
D1
D2
D3
D0
D1
D2
D3
D0
D1
D2

METHOD FOR DISPLAYING IMAGES ON A MATRIX SCREEN

CROSS-REFERENCE TO RELATED APPLICATION

This application claims priority to foreign French patent application No. 1553140, filed on Apr. 10, 2015, the disclosure of which is incorporated by reference in its entirety.

FIELD OF THE INVENTION

The invention relates to a method for displaying images on an active matrix screen. This type of screen has advanced greatly in recent years notably for screens of liquid crystal type, known by their abbreviation LCD. More recently, other types of screens implementing light-emitting diodes have been developed, notably using organic diodes or micro diodes, known by their abbreviations: OLED, respectively μLED.

Each of the pixels of an active matrix screen contains at least one transistor which serves as switch connected to a storage component which makes it possible to store a useful signal for the duration of a frame. In the case of a liquid crystal screen, these two elements are sufficient to excite the crystal. In the case of a diode screen, each pixel contains a second transistor which makes it possible to drive the powering of the light-emitting diode as a function of the useful signal stored in the storage component.

It is known practice to drive the display by analogue means. More specifically, once per frame, each pixel receives, via its transistor, a voltage representative of the brightness that the pixel must display. This voltage is stored in the storage component, for example a capacitor. For an LCD pixel, the voltage is directly applied to the electrodes surrounding the liquid crystal. For a diode pixel, the voltage is applied to the second transistor configured as follower to power the diode proportionally to the stored voltage.

Analogue driving presents a number of drawbacks:

- Voltage leaks at the capacitor can occur during the frame duration. This is reflected in a flickering phenomenon which is amplified under the influence of temperature for the duration of the frame.
- Upstream of the first transistor, the voltages pass through conductors of the matrix, generally column conductors. In the addressing of a row of pixels, the voltage variations that occur on the column conductors can disturb the pixels of the other unaddressed rows, by capacitive coupling between the column conductors and the unaddressed storage capacitors. This is reflected in artefacts in the image displayed.

In the case of a diode screen, the light-emitting diodes can require a high bias voltage. All of the pixel has to be compatible with this voltage. The voltage stored in the capacitor must then be equal to the bias voltage of the diode to which is added the gate-source voltage of the second transistor. Since the current CMOS technologies are limited to approximately 5V, the voltage applied to the light-emitting diode is then subject to a sealing of less than 4V, which can represent a limitation on the performance levels that can be achieved in the brightness of the screen.

Still in the case of a diode screen, the follower transistors powering the diodes can have non-uniform characteristics which provokes a spatial noise phenomenon in the display, because, for a same control voltage for distinct pixels, the biasing of the diode can then vary from one pixel to another.

Furthermore, the follower transistor works in saturated regime and it has to absorb a voltage difference that is inversely proportional to the lighting of the light-emitting diode. The power dissipated in this transistor leads to a significant overheating, which can pose thermal dissipation problems, notably when this transistor is located in an internal layer of the screen.

It is also known practice to drive the display by digital means. This type of driving has been notably implemented for light-emitting diode screens, and also for micromirror-based screens for projectors implementing components known in the literature as DLP, the abbreviation for "Digital Light Processing". For the diode pixels, the components of each of the pixels are arranged in the same way as for a diode pixel driven by analogue means. There is a first transistor making it possible to store an information item in a capacitor and a second transistor driving the switching on of the diode as a function of the information item stored in the capacitor. Unlike the analogue driving, for the digital driving, the diodes of each of the pixels are driven in on or off mode, that is to say that the diode is either connected to its maximum voltage, therefore switched on, or disconnected, therefore switched off. The brightness of the diode is controlled by the modulation of the width of the pulse applied between its terminals. The visual perception, because of the inertia of the eye, is the average of the sum of all of the diode switch-on times.

The control is binary. It applies two possible voltage levels to the gate of the second transistor, which works in switch mode. The amplitude between these two levels has to be sufficient to block or not block the second transistor, which can be produced with relatively low voltage values.

The digital driving presents a number of advantages over analogue control:

- Reduced dissipation on the second transistor which operates in switch mode. The voltage between its drain and its source is very low when it is conducting.
- Control voltage that is binary and of low amplitude.
- Immunity to the various couplings and leaks, because the pixels operate in binary mode.
- No impact from the dispersions of the characteristics of the components of the pixel because of their use in on or off mode.
- No brightness limitation linked to the voltage present at the terminals of the capacitor, since the second transistor does not work in saturated mode but in switch mode.

The main drawback with digital driving is the high operating frequency of the matrix. In effect, to modulate the pulse width on the light-emitting diode of each pixel, each pixel, and therefore each row, has to be addressed a number of times per frame.

This drawback occurs notably with a binary code modulation driving method well known in the literature by the acronym BCM. This method is also known as "time grey-scale method".

In this family of driving methods, the brightness of a pixel is coded in the form of a binary word. Each bit of the binary word drives the diode for a duration proportional to the weight of the bit.

The light-emitting diode is driven for a time proportional to the weight of the bit of the value to be displayed. For example, the most significant bit (MSB) drives the diode for half the duration of the frame (for example 10 ms for a frequency of 50 images/second). The next bit (MSB−1) represents a quarter of this duration, and so on to the least significant bit (LSB). By convention, the diode is switched on when the value of a bit is 1 and is switched off when the value of a bit is 0. The reverse convention is of course possible.

For example, if the brightness of a pixel is coded on 8 bits, a value of the binary word of 01010101 (=85) will give a brightness of the pixel in a ratio of 85/256 relative to the maximum brightness of the pixel.

For such driving, it is necessary to access the pixel 8 times per frame, thus defining 8 subframes. During the sequential writing of the matrix, it is often necessary to switch off the light-emitting diodes in order to allow for the complete addressing of the matrix and observe the proportion between the different subframe durations. This switch-off duration can be estimated as the duration of driving of the least significant bit. The value of the reduction of the brightness is $P/2^P$, with P equal to the number of brightness bits. The loss is, for example, of the order of 3% for P=8 and 1% for P=10 bits. These brightness losses can sometimes be acceptable, but the necessary operating frequencies can be prohibitive for matrixes of large dimensions.

For a rapid addressing, for example based on the duration of the least significant bit, the frequency $F_{row}$ at which each row of the matrix has to be addressed is equal to:

$$F_{row}=\text{fps}*N_{row}*2^P$$

fps defining the number of images per second and $N_{row}$ the number of rows of the matrix.

The frequency $F_{pix}$ at which the writing has to be done in each of the pixels of a row is the frequency $F_{row}$ multiplied by the number of pixels per row which corresponds to the number of columns $N_{col}$ of the matrix:

$$F_{pix}=F_{row}*N_{col}$$

For a matrix format of 640 columns by 480 rows, the format known as VGA, for a coding of the brightness on 10 bits, the frequency $F_{pix}$ is then greater than 15 GHz and, for a format of 1920 columns by 1200 rows, a format known as WUXGA, still for a coding on 10 bits, the frequency $F_{pix}$ is then 118 GHz. These frequencies are in practice difficult to achieve by low-cost technologies. They also involve significant consumptions.

It would be possible to arrange the inputs in parallel in order to reduce the frequencies in play, but this would be detrimental to the simplicity and the number of inputs would have to be increased.

By accepting a loss of brightness, it is possible to increase the write duration. For example, for a brightness coded on 10 bits, with a brightness reduction of 10%, the frequencies in play would be reduced by a factor of 10. Even with this concession of the maximum brightness of the screen, the frequencies for large formats still remain very high.

SUMMARY OF THE INVENTION

The invention aims to mitigate all or some of the above-mentioned problems by proposing a digital driving method that makes it possible to reduce the pixel addressing frequency.

To this end, the subject of the invention is a method for displaying images on a matrix screen p comprising a number of rows of pixels, the rows being ordered from i=1 to i=N, i representing a pointer of a current row and N the number of rows, each pixel comprising a display component and a memory, the matrix screen comprising addressing means for each of the rows and data transfer means to the memory of each of the pixels, the method consisting in controlling the brightness of each of the pixels of the matrix screen by means of a binary word comprising a number of bits written successively through the data transfer means, into the memory and by controlling the display component as a function of a state of the bit written into the memory, the bits of each binary word being ranked according to their weight from j=1 to j=P, the method being characterized in that it consists in sequencing the following writes for the duration ($T_{frame}$) of an image frame:

from a current row i, writing on the rows $i+2^j$, from j=1 to j=P, the bit of weight j of each binary word associated with the different pixels of the rows $i+2^j$;

repeating, $2^P-1$ times, the writes mentioned above by shifting the pointer i of the current row by one rank unit on each repetition;

the rank of the pointer i of a row being determined modulo $2^P-1$ so as to lie between 1 and $2^P-1$.

The choice of the first current row from which the repetitions are performed is completely arbitrary. i represents a row pointer which is incremented on each write and the complete sequencing of the writes is performed after $2^P-1$ write periods.

For each current row i, the writes performed on the rows $i+2^j$ occupy a period $T_i$. Advantageously, the $2^P-1$ periods $T_i$ have equal durations.

Advantageously, the duration of a period $T_i$ is equal to the duration of an image frame divided by $2^P-1$.

In a particular embodiment of the matrix, each of the pixels further comprises a switch making it possible to control the display component as a function of a state of the bit written into the memory. For each of the pixels, the switch is actuated to drive the display component as a function of the bit written into the memory for a duration extending between two successive writes.

In another particular embodiment of the matrix, the method can further consist, for each of the pixels, in activating the display component after writing in the corresponding memory. The writes on the rows $i+2^j$ performed from the current row i are performed during a period. The display component is activated for a duration extending from the end of the period during which the brightness bit was written to the end of the next period during which a new write is performed in the pixel concerned.

In this other embodiment, the memory of each pixel is called first memory. Each pixel advantageously comprises a second binary memory making it possible to pass the bit written in the first memory to the display component to activate it. The addressing means drive the first memory by means of a write-enabling first signal and drive the second memory by means of a second signal distinct from the first signal and making it possible to activate the display component.

If the brightness is expressed as a number of R useful bits and the number of rows N is greater than $2^R-1$, then the binary word can have added to it a number T of bits whose values are equal to zero, corresponding to a switching off of the display components so that N is less than or equal to $2^P-1$ with P=R+T.

Alternatively, if the brightness is expressed as a number of S useful bits and the number of rows N is greater than $2^S-1$, the matrix is divided into areas driven separately, each of the areas having a number of rows less than or equal to $2^S-1$.

If the matrix comprises a number of useful rows U less than $2^P-1$, then the distribution of the writes is configured to sequence the writes on N rows with $N=2^P-1$ with U useful rows and V virtual rows with U+V=N. For the virtual rows, the binary word contains only bits of a value corresponding to a switching off of the display component.

For each given current row i, the writes on the rows $i+2^j$, from j=1 to j=P, of the different bits are advantageously ordered so as to minimize an error over a desired duration separating two successive writes of a same pixel.

For each given current row i, the writes on the rows $i+2^j$, from j=1 to j=P, of the different bits, can be performed for a duration less than the duration of a period equal to the duration of a frame divided by the number of rows written.

BRIEF DESCRIPTION OF THE DRAWINGS

The invention will be better understood and other advantages will become apparent on reading the detailed description of an embodiment given by way of example, the description being illustrated by the attached drawing in which:

FIGS. 8*a* and 8*b* represent, in timing diagram form, a first mode of sequencing of the write periods described previously;

In the interests of clarity, the same elements will bear the same references in the different figures.

DETAILED DESCRIPTION

Figure 1:
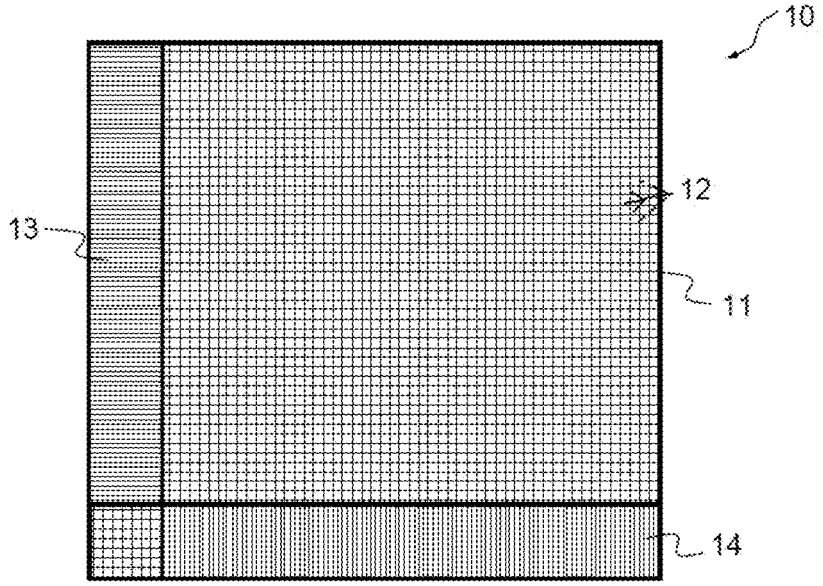
FIG. 1 schematically represents a matrix screen intended to operate with a method according to the invention.

FIG. 1 represents a matrix screen 10 comprising a display area 11 formed by pixels 12 organized in rows and in columns, a row addressing circuit 13 and a horizontal register 14. Each pixel 12 lights up as a function of a brightness datum expressed in the form of a binary word. The row addressing circuit 13 selects the rows of the matrix one by one and, for each pixel 12 of a selected row, the binary word stored in the horizontal register 14 and representing the brightness is transferred bit by bit to the corresponding pixel 12.

Figure 2A:
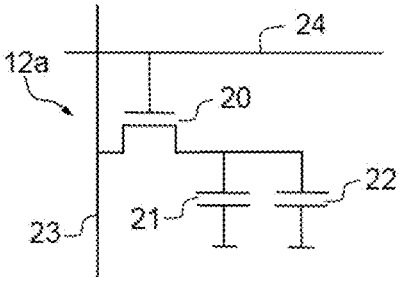
FIGS. 2*a*, 2*b* and 2*c* represent three examples of pixel schemes that can be implanted in the matrix screen of FIG. 1.
Figure 2B:
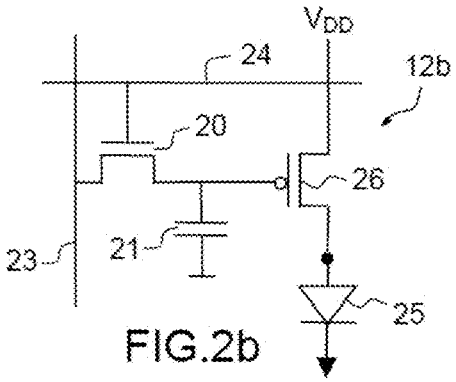
Figure 2C:
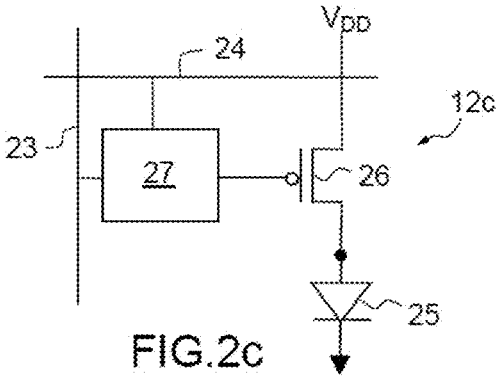

FIGS. 2*a*, 2*b* and 2*c* represent three examples of pixel schemes 12 that can be implemented in the screen of FIG. 1. These three examples of pixels can be implemented in a monochrome or colour screen. For a colour screen, the term "colour pixel" is sometimes used, which is in fact formed by the juxtaposition of a number of pixels each associated with a coloured filter. Each group of pixels receives distinct brightness commands for each of the colours. The method of the invention is illustrated on the basis of pixels implemented in a monochrome screen and can be transposed to the driving of a colour screen by replicating the control of each of the individual pixels forming the colour pixel.

FIG. 2*a* schematically represents the main components of a liquid crystal pixel 12*a*. The pixel 12*a* comprises a switch 20, a storage capacitor 21 and a liquid crystal cell 22. The pixel 12*a* is connected to a column conductor 23 conveying the brightness data from the horizontal register 14. The switch 20, for example formed by a transistor, makes it possible to transfer the brightness data from the column conductor 23 to the capacitor 21. The pixel 12*a* is also connected to a row conductor 24 connected to the row addressing circuit 13. The switch 20 is driven by the row conductor 24. The datum stored in the capacitor 21 forms a voltage directly applied to one of the electrodes of the cell 22. The datum stored in the capacitor 21 is binary. One of the binary states renders the cell 22 transparent and the other state renders the cell 22 opaque. In the case of a backlit screen 10, the cell 22 therefore allows the light to pass as a function of the binary state of the datum stored in the capacitor 21. The cell operates in on or off mode as a function of the binary state of the datum stored in the capacitor 21.

FIG. 2*b* schematically represents the main components of a light-emitting diode pixel 12*b*. The pixel 12*b* again comprises the switch 20 and the storage capacitor 21, both connected to the conductors 23 and 24. Instead of the cell 22, the pixel 12*b* comprises a light-emitting diode 25 and a second switch 26 making it possible to power the diode 25 by means of a power supply voltage $V_{DD}$. The switch 26 can also be a transistor. The switch 26 is driven by the datum stored in the capacitor 21.

FIG. 2*c* represents a pixel 12*c* forming a variant of the pixel 12*b*. In the pixel 12*c*, the capacitor 21 is replaced by a binary memory 27. This memory makes it possible to store a binary information item. The binary memory can be formed by a bistable flip-flop connected at its input to the column conductor 23 and at its output to the driving terminal of the switch 26. The memory 27 is driven by the row conductor 24. The modification of the information item stored in the memory 27 occurs upon a command conveyed over the row conductor 24.

Such a memory can also be implemented for a liquid crystal pixel by replacing the capacitor 21 of the pixel 12*a*. The implementation of a memory can be advantageous for a matrix comprising pixels produced by using a CMOS technology. The switches 20 and 26 and the memory 27 then all use the same technology.

Hereinbelow, the term memory will be used equally for a capacitor and for any other component or component block making it possible to store a binary information item. To this end, the capacitor 21 is likened to a memory.

The invention can be implemented for any type of pixel making it possible to emit light like those comprising a light-emitting diode, to control the light which passes through it like those comprising a liquid crystal cell or to control the reflection of the light like those implemented in a screen or a projector based on micro-mirrors. Hereinbelow, the component of the pixel making it possible to emit or to control the light will be called display component.

In the driving method of the invention, the brightness of a pixel is controlled by means of a binary word representing a fraction of the maximum brightness of the pixel. To display an image, each of the pixels is assigned a brightness value coded in the form of a binary word. For the duration of an image, the different bits of the binary word are written in the memory of the pixel and used by the display component operating in on or off mode for a fraction of the duration of the image. This fraction of duration is a function of the weight of the bit in the binary word. The most significant bit is used by the display component for substantially half the duration of an image, the next bit, for a quarter of the duration of the image and so on by dividing the fraction by two until the least significant bit. The screen 10 makes it possible, for example, to display fifty images per second. The retinal persistence of a user makes it possible to average these fractions of duration to reconstitute the average brightness of the pixel. The method of the invention consists in writing, row by row, the different bits of the binary words in the different memories of the corresponding pixels so as to reduce the writing frequency necessary to scan all the matrix.

It is possible to deactivate the display component for a certain time by controlling the backlighting for a liquid crystal or micro-mirror screen or by disconnecting the diode power supply.

The invention addresses the sequencing of write periods in the different pixels of the matrix.

More specifically, from a matrix of N rows, i representing the pointer of a current row, by considering the bits of each binary word ranked according to their weight from j=1 to j=P, 1 representing the least significant bit and P the most significant bit, the method consists in sequencing the following writes for the duration of an image frame:

from a current row i, writing on the rows $i+2^j$, from j=1 to j=P, the bit of weight j of each binary word associated with the different pixels of the rows $i+2^j$;

repeating, $2^P-1$ times, the abovementioned writes by shifting the pointer i of the current row by one unit on each repetition;

the rank of the pointer i of a row being determined modulo $2^P-1$ so as to lie between 1 and $2^P-1$.

By considering a matrix comprising N rows with $N=2^P-1$, for a particular period in which i is set at N−1, P rows are written during this period. With the modulo $2^P-1$ row numbering convention, N in the present case:

the least significant bit LSB (j=1) is written on the row: $(N-1)+2^1=N+1=1$.

the bit LSB+1 (j=2) is written on the row: $(N-1)+2^2=N+3=3$.

the bit LSB+2 (j=3) is written on the row: $(N-1)+2^3=N+7=7$.

And so on until the most significant bit (j=P) which is written on the row: $(N-1)+2^P=2N=N$.

During a given period, the least significant bit has just been written on a given row (i+1 with the convention previously used). This same row will be written again in the immediately following period. On the other hand, for the row on which the most significant bit has just been written, it will be necessary to wait substantially N/2 periods for this same line to be rewritten. This method makes it possible to maintain a usable writing by the display component for a variable duration as a function of the weight of the bit written. This duration is substantially equal to $(2^j/2^P)\times$ (frame duration/2).

For each current row i, the writes performed on the rows occupy a period $T_i$. In other words, each of the repetitions occupies a period $T_i$. To produce a complete frame, $2^P-1$ periods $T_i$ are strung together. Advantageously, the different periods have the same duration. That makes it possible to correctly observe the match over a frame between the value of the binary word and the sum of the durations of activation of the display component.

To limit the brightness losses relative to a maximum brightness corresponding to a complete activation of the display component for a complete frame, the different periods occupy all of the frame. In other words, the duration of a period $T_i$ is equal to the duration ($T_{frame}$) of an image frame divided by $2^P-1$.

Figure 3:
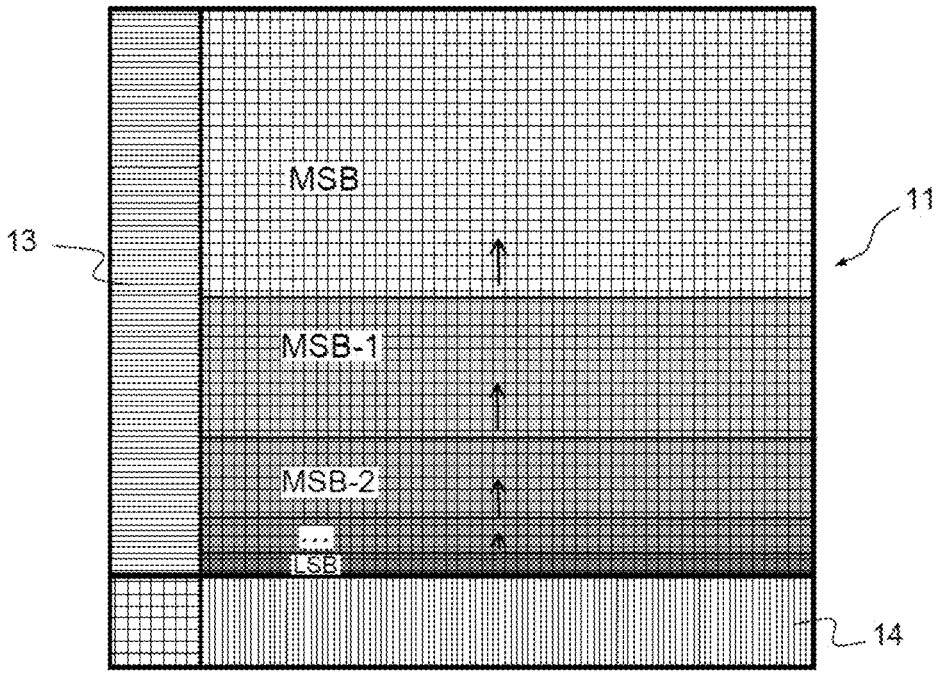
FIG. 3 illustrates a step of writing brightness data in the pixels of the screen of FIG. 1.

FIG. 3 represents, visually over a frame, the usable durations for each of the bits of the binary word coding the brightness of each of the pixels. Since each row of the matrix is scanned during a frame, the durations between each rewriting can be expressed as a number of rows representing fractions of the total duration of the frame. In FIG. 3, half of the rows of the matrix contain the most significant bits MSB, a quarter of the rows contain bits of weight MSB−1, an eighth of the rows contain bits of weights MSB−2 and so on as far as a single row, the lowest row in FIG. 3, containing least significant bits.

The implementation of the invention makes it possible to significantly reduce the frequency of addressing and of writing of the different bits of the binary word representing the brightness of each of the pixels of the matrix. With a digital driving from the prior art, the row frequency is given by:

$$F_{row}=\text{fps}*N_{row}*2^P$$

With a digital driving implementing the invention, the row frequency becomes:

$$F_{row}=\text{fps}*(2^P-1)*P$$

The frequency is lowered in a ratio close to: $N_{row}/P$.

Figures 4A, 4B, 4C, 4D:
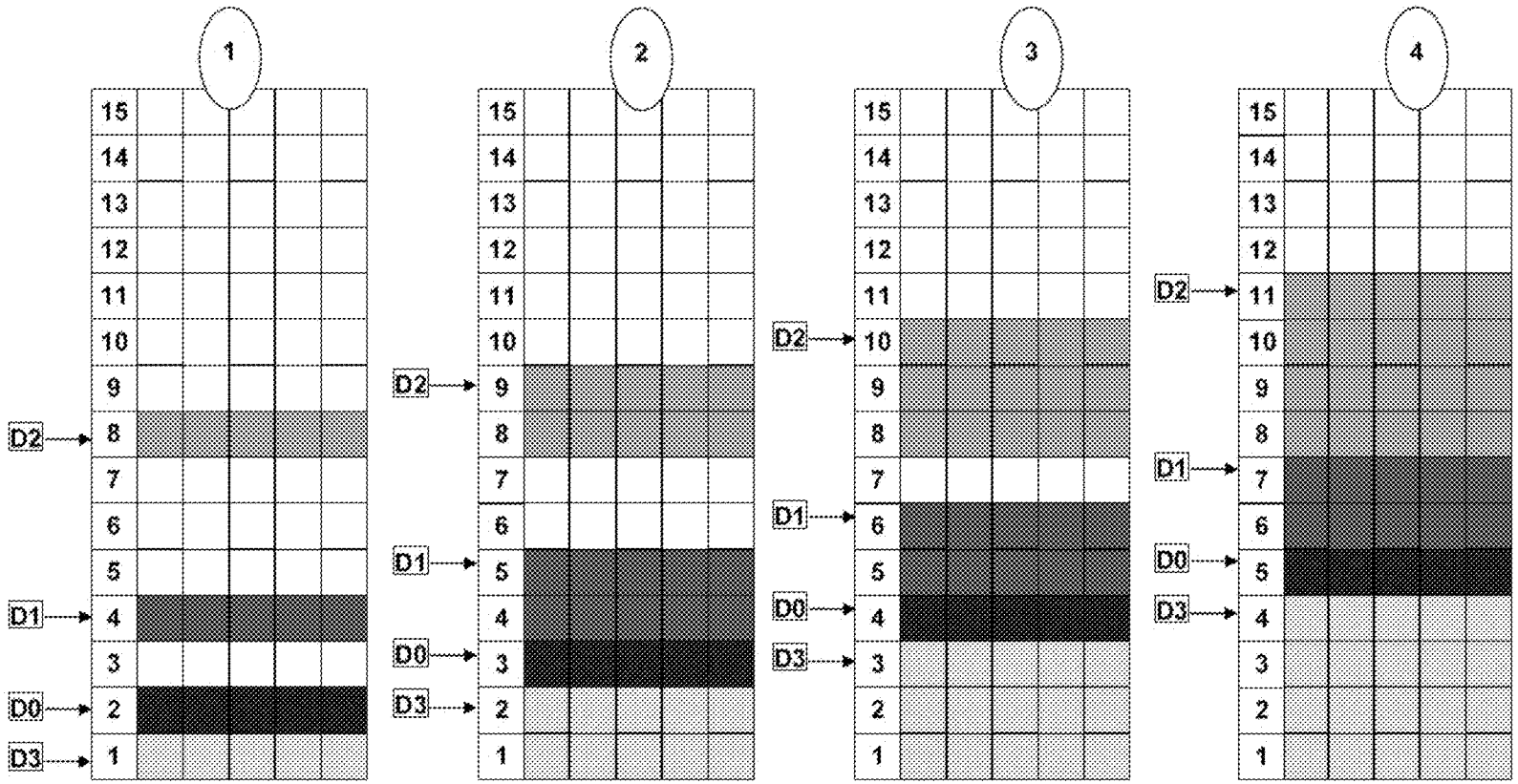
FIGS. 4*a* to 4*p* represent a sequencing of periods of writing in memories of the pixels of the matrix.
Figures 4E, 4F, 4G, 4H:
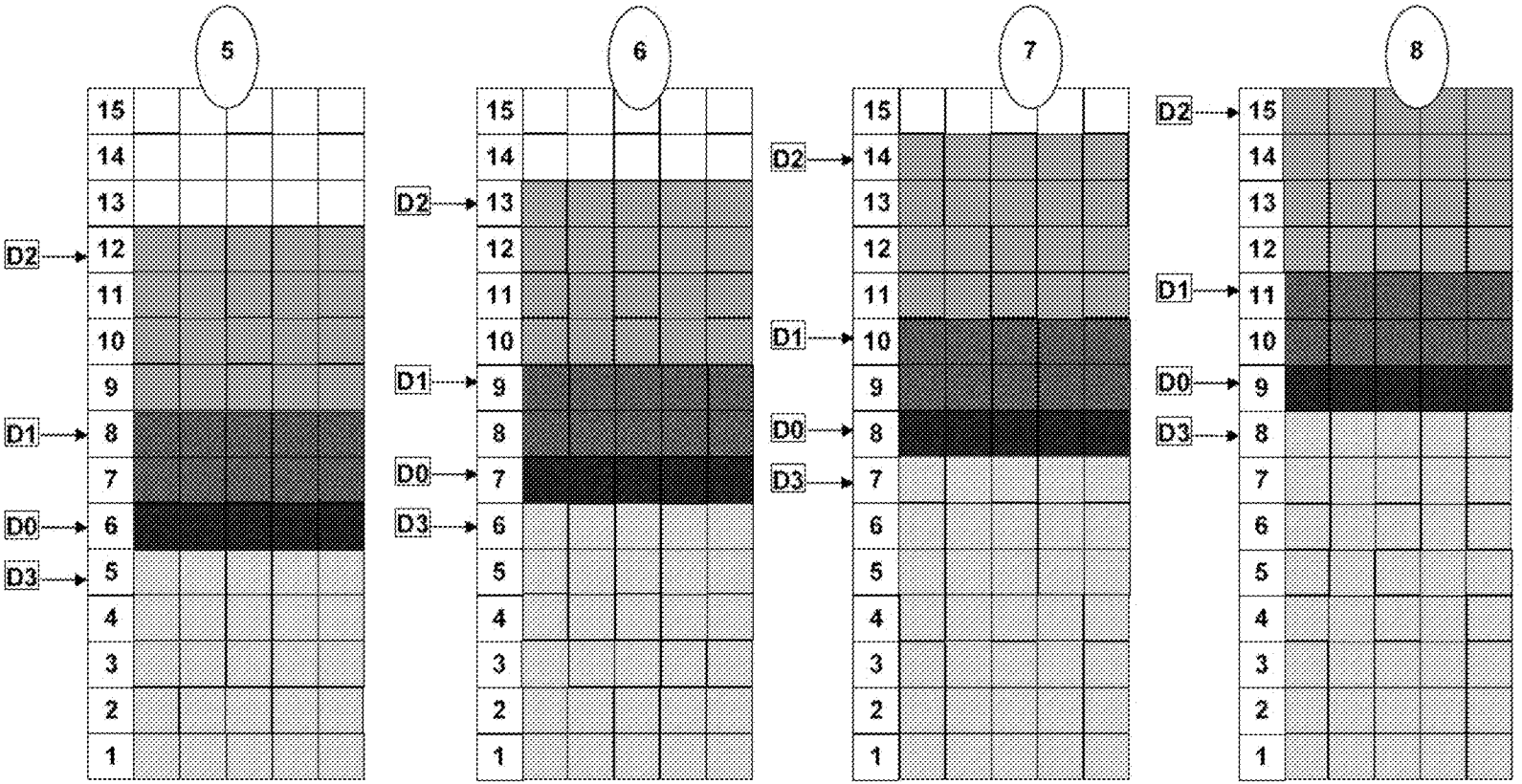
Figures 4I, 4J, 4K, 4L:
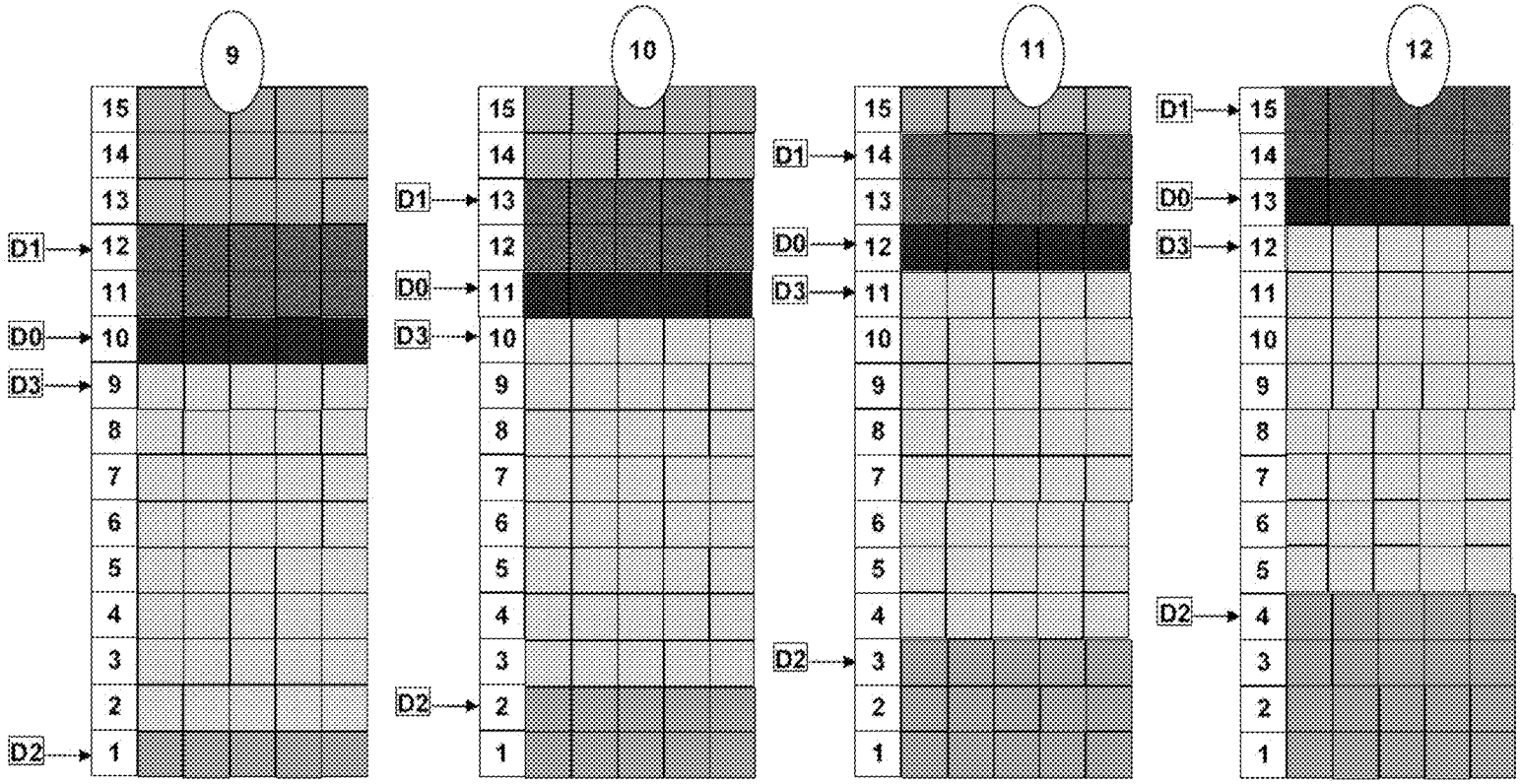
Figures 4M, 4N, 4O, 4P:
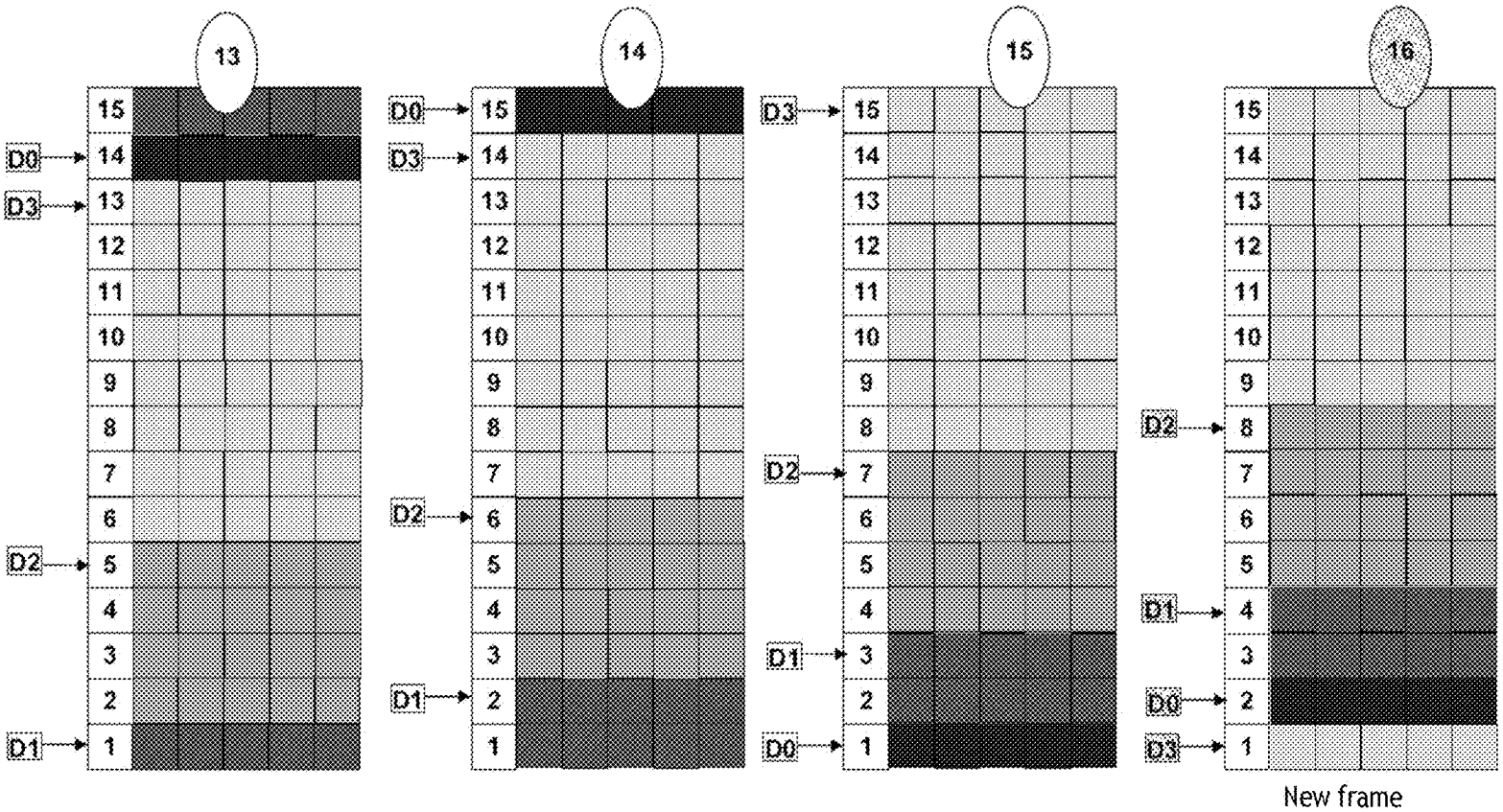

FIGS. 4*a* to 4*p* represent an example of sequencing of periods of writing in the memories of the different pixels of the matrix. More specifically, in the example illustrated with FIGS. 4*a* to 4*p*, the brightness is coded on four bits. Obviously the brightness can be coded on a greater (or lesser) number of bits. For a user to perceive practically no brightness difference between two successive levels of coding of the brightness of a pixel, a coding on 8 to 10 bits can be suitable. In the example illustrated, the matrix comprises N=15 rows of pixels, which corresponds to $2^P-1$ rows, P representing the number of bits of the coding of the brightness. The invention is not limited to this number of rows. It will be seen later how to increase or reduce the number of rows relative to $2^P-1$.

Conventionally, the binary words coding the brightness, comprise bits identified D0, D1, D2 and D3, ordered from the least significant bit D0 also referred to by its abbreviation LSB, to the most significant bit D3 also referred to by its abbreviation MSB.

During the first writing period, represented in FIG. 4*a*, the most significant bit D3 is written on the first row of the matrix, the least significant bit D0 is written on the second row, the bit D1 is written on the fourth row of the matrix and the bit D2 is written on the eighth row of the matrix. For each column 23 of the matrix, a single bit can be written simultaneously. The four writes of the bits D0 to D3 are performed in succession during the same period. For this first period, the last row is considered to be the current row i (i=N).

For the second period, represented in FIG. 4*b*, the current row i is shifted by one rank: i=N+1 modulo $2^P-1$, that is to say i=1. More specifically, during the second period, represented in FIG. 4*b*, the most significant bit D3 is written on the second row of the matrix, the least significant bit D0 is written on the third row, the bit D1 is written on the fifth row of the matrix and the bit D2 is written on the ninth row of the matrix.

The periods 3 to 15 are then sequenced in the same way by shifting the current row on each period by one row. In the eighth period, represented in FIG. 4*h*, the bit D2 is written on the eighth row. Having reached the last row of the matrix, the shifts performed for the ninth period are made in a revolving fashion, that is to say that the shifts are incremented by one unit modulo the number of rows of the matrix. In other words, it is considered that the fifteenth row of the matrix is followed by the first row and in the ninth period the bit D2 is written on the first row of the matrix.

During the period 15, represented in FIG. 4*o*, the current row is the row 14. During the periods 1 to 15, all the rows of the matrix have been written with all the bits of the binary words representing the brightness of the different pixels of the matrix. FIG. 4*p* represents a period 16 for a new image or frame. This period 16 is similar to the period 1 with new values of the binary words corresponding to the new image.

In practice, it is possible to start the sequencing of the writing periods on any row of the matrix. The complete sequencing is performed at the end of $2^P-1$ writing periods.

Figure 5:
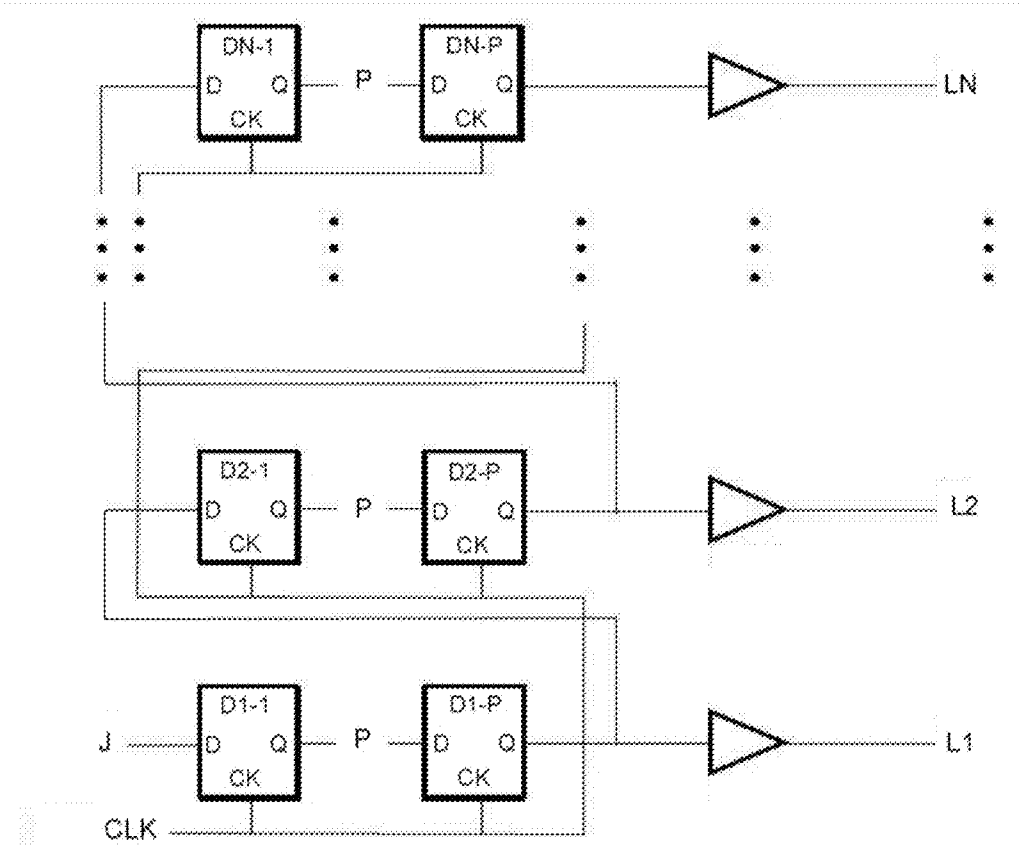
FIGS. 5, 6 and 7 represent examples of registers that make it possible to drive the matrix.

FIG. 5 represents an exemplary shift register that can be used in the row addressing circuit 13 to generate the signals for selecting the rows Li, signals conveyed on the row conductors 24. For each row i, the signal Li is formed using P D flip-flops: Di−1 to Di-P connected in series. The output of the flip-flop Di-P forms the signal Li of the row i and is connected to the input of the flip-flop Di+1−1. A clock signal CLK is common to all the D flip-flops. Tokens J are introduced at the input of the flip-flop D1−1 with a time difference of $2^j$ times the duration of a period. This embodiment of the row addressing circuit 13 presents a drawback due to the large number of flip-flops which have to switch simultaneously. This means significant and non-negligible consumption peaks. The surface footprint of this type of register is also detrimental.

Figure 6:
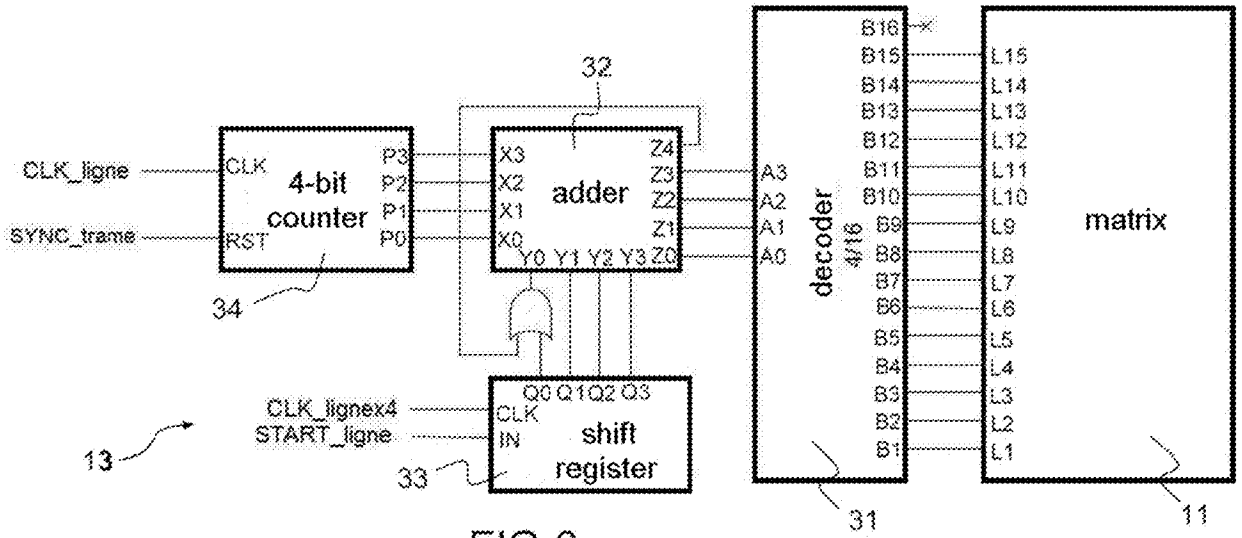

FIG. 6 represents an alternative making it possible to produce the row addressing circuit 13. This alternative is more compact and consumes less energy. The row addressing circuit 13 comprises an address decoder 31, an adder 32, a P-bit shift register 33 and a P-bit counter 34, P=4 in the example represented. The counter 34 receives a clock CLK operating at the frequency of each period. The shift register 33 receives a clock P times faster than the clock of the counter 34 and a start token Start at the start of each period. The shift register 33 shifts the start signal in pace with its clock which makes it possible to send to the adder 32 a binary number equal to $2^P$. The adder 32 also receives the output from the counter 34. The adder 32 performs the addition of the binary number and the output of the counter 34. The result of the addition is transmitted to the P to N decoder, here a 4 to 16 decoder of which only fifteen outputs are connected, each to a row conductor 24 of the matrix 11. For each period, the rows of rank $2^j$+k are addressed in succession, k representing an integer number incremented by one unit by the counter 34 on each new period.

Figure 7:
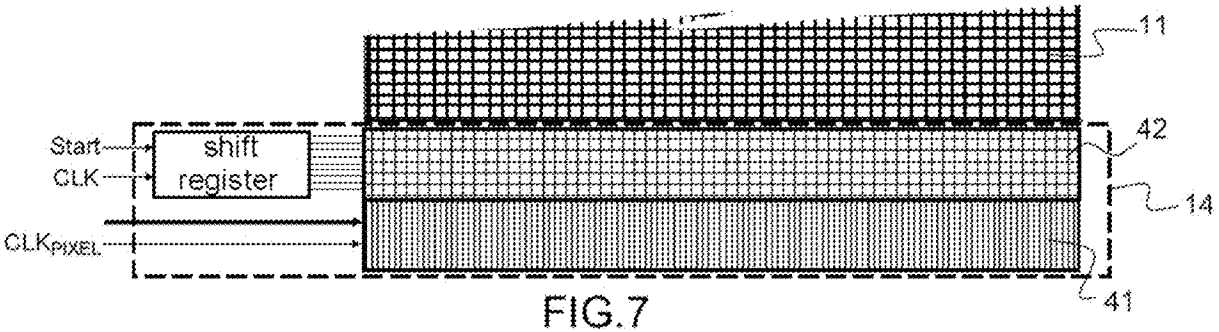

FIG. 7 represents an exemplary embodiment of the horizontal register 14 which comprises two shift registers 41 and 42 having as many bits as rows in the matrix. The register 41 is used as buffer to store the brightness data. The register 42 is used for the sequential writing of the rows addressed by the row addressing circuit 13.

Figure 8A:
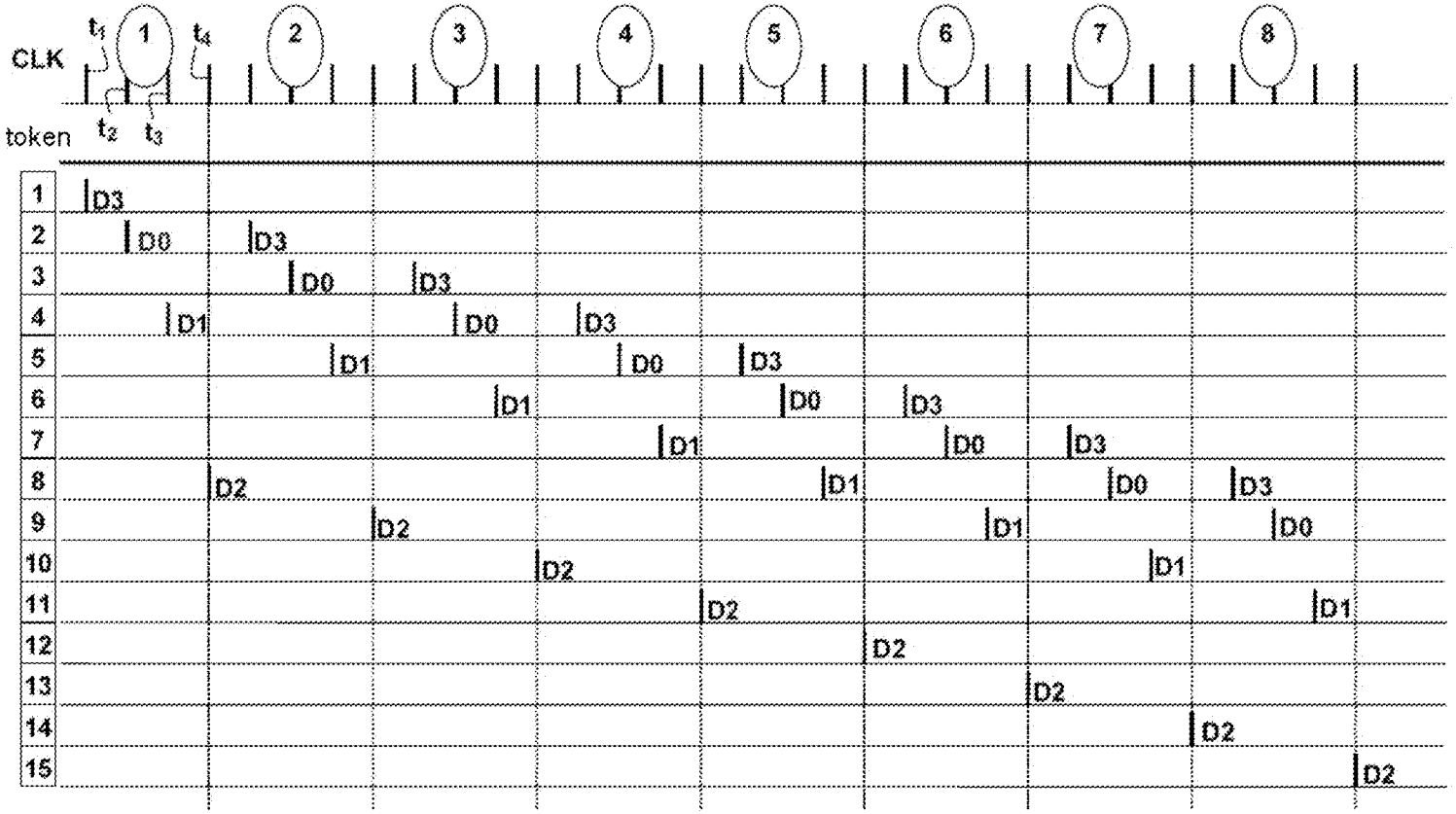

FIGS. 8*a* and 8*b* represent, in timing diagram form, the writing periods described previously. These timing diagrams can be easily implemented using the row addressing circuits described in FIGS. 5 and 6. FIGS. 8*a* and 8*b* make it possible to illustrate a first embodiment of succession of the different writes within the periods.

At the top of the timing diagram a regular clock CLK makes it possible to pace the different writes of the different periods. Under the representation of the clock CLK, there are represented, row by row, the writes of the different bits of the words representing the brightness of the different pixels.

During the first period, four clock pips $t_1$ to $t_4$ occur. On the first pip $t_1$, the bit D3 of the first row is written. On the second pip $t_2$, the bit D0 of the second row is written. On the third pip $t_3$, the bit D1 of the fourth row is written and on the fourth pip $t_4$, the bit D2 of the eighth row is written.

On each period, the shifting of a current row described above makes it possible to reconstruct the complete timing diagram of FIGS. 4*a* and 4*b* from the first period to the period 16 represented in FIG. 8*b*.

This first embodiment presents the advantage of a regular clock and of a write in the order of the weights of the bits. Nevertheless, the duration for each bit is not exactly a multiple of the duration of a period because of the division of the period into four phases. For example, the least significant bit D0 can be used by the display component for a duration of ¾ of a period and the bit D1 for 1+¾ of a period. This quantization error is due to the choice of the sequence of the different bits. This error can be acceptable for a coding of the binary words over a larger number of bits.

Figure 9:
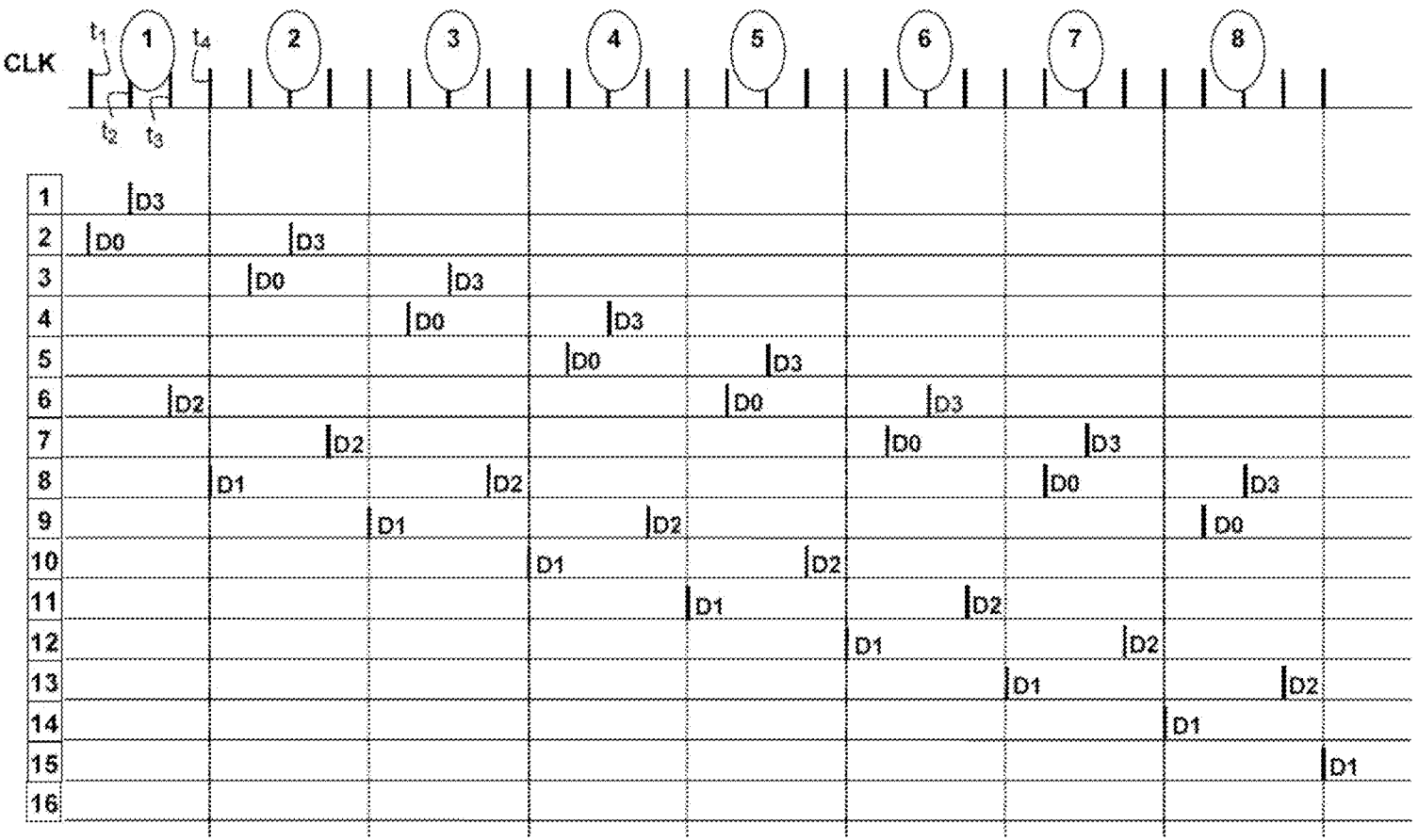
FIGS. 9 and 10 represent variants of the timing diagram of FIGS. 8*a* and 8*b;*

FIG. 9 represents a timing diagram of a second embodiment of the sequencing of the writes making it possible to reduce the error described previously. There is still a regularly distributed clock. For simplicity, only the first periods are represented in this figure. In this second embodiment, during the first period, on the first pip $t_1$, the bit D0 of the second row is written. On the second pip $t_2$, the bit D3 of the first row is written. On the third pip $t_3$, the bit D2 of the sixth row is written and on the fourth pip $t_4$, the bit D1 of the eighth row is written. In this embodiment, the least significant bit D0 can be used by the display component for a duration of 1+¼ of a period, the bit D1 for 1+¾ of a period, the bit D2 for 3+½ of a period, the bit D3 for 8+¼ of a period. The error on the duration remains this time less than half of the duration expected for the least significant bit D0. This error is typically of the same order of magnitude as that of a digital-analogue converter often used in a horizontal register implemented in analogue driving. It is possible to empirically test different scheduling of the brightness bits in order to minimize the quantization error.

Figure 10:
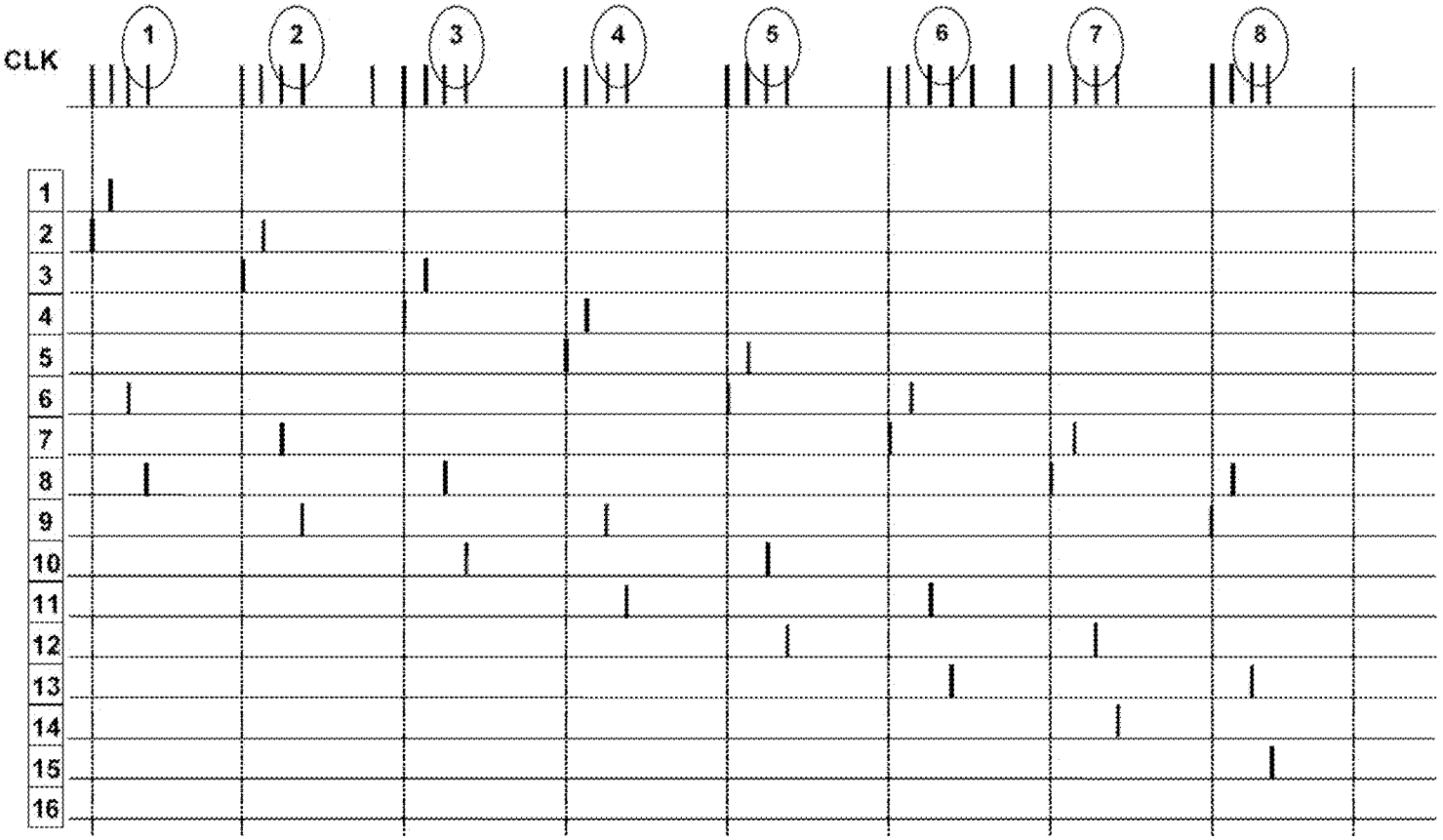

FIG. 10 represents a timing diagram of a third embodiment of the sequencing of the writes making it possible also to reduce the error on the durations of use of the different bits. The four phases of a period are, this time, generated for a duration less than that of the period whose duration is equal to the duration of an image frame divided by the number of rows written $2^P-1$. To illustrate this embodiment, the four phases are, for example, generated for half the period. This is done by doubling the clock frequency. The error is then divided by two.

It is of course possible to couple the second and third embodiments by proposing a sequencing of the bits different from the natural sequencing in the order of the weights of the bits and by increasing the clock frequency to concentrate the writings of the different bits in only a part of each of the periods.

It is possible to completely eliminate the quantization error whatever the scheduling retained for the writing of the different brightness bits by activating the display component for a duration extending from the end of a period during which the brightness bit was written to the end of the next period during which a new write is performed in the same pixel. This duration of activation can be obtained by adding, in the pixel, a second memory driven by a specific row signal.

Figure 11A:
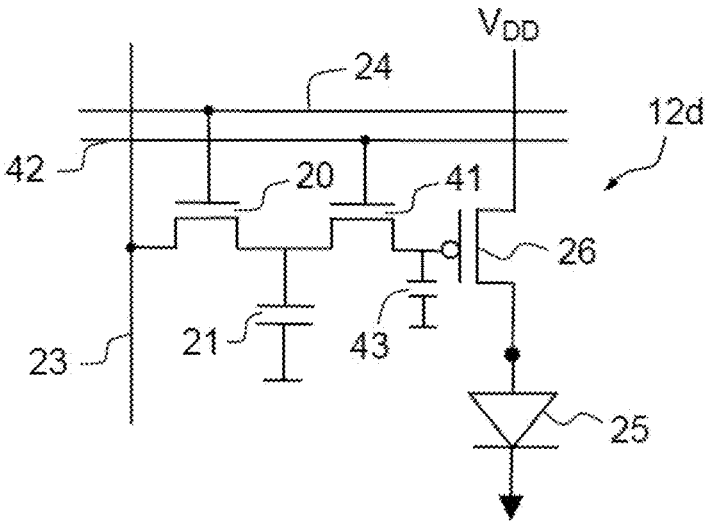
FIGS. 11*a* and 11*b* represent two variant pixel schemes that can be implanted in the matrix screen of FIG. 1.

FIG. 11*a* represents a pixel 12*d* making it possible to implement this duration of activation that is shifted relative to the write. In this pixel, there is, as in the pixel 12*b*, the switch 20, the storage capacitor 21, both connected to the conductors 23 and 24, the light-emitting diode 25 and the switch 26 making it possible to power the diode 25 by means of the power supply voltage $V_{DD}$. In the pixel 12*d*, the capacitor 21 does not directly drive the switch 26. A new switch 41 is interposed between the capacitor 21 and the driving gate of the switch 26. The switch 41 is driven by a specific signal conveyed over an additional row conductor 42 distinct from the conductor 24. A stray capacitance 43 present at the common point of the switches 26 and 41 serves as second memory driven by the specific signal. If necessary, it is of course possible to add a capacitor to complement the stray capacitance. The specific signal makes it possible to pass the charges stored in the capacitor 21 to the stray capacitance 43 at the desired moment.

Figure 11B:
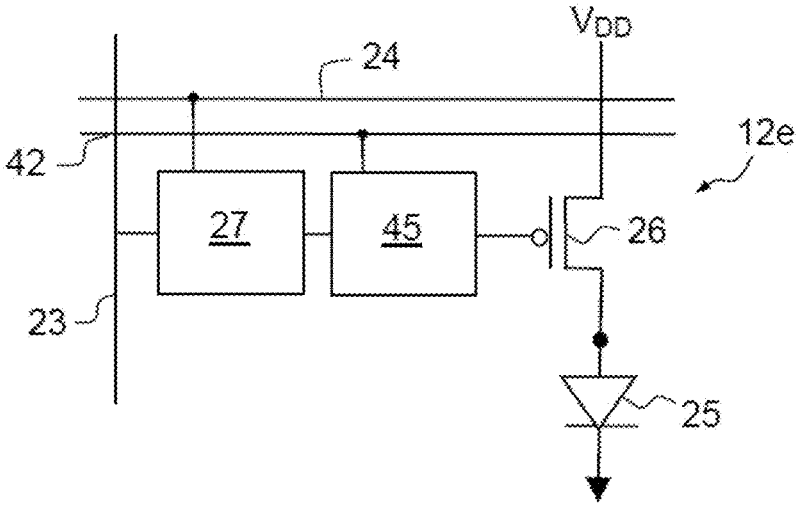

FIG. 11*b* represents a pixel 12*e* forming a variant to the pixel 12*d* that also makes it possible to implement the shifting of the duration of activation relative to the write. In the pixel 12*e*, as in the pixel 12*c*, there is the binary memory 27 receiving an information item to be stored by the column conductor 23 and driven by the row conductor 24. There are also the light-emitting diode 25 and the switch 26 making it possible to power the diode 25 by means of a power supply voltage $V_{DD}$. In the pixel 12*e*, the binary memory 27 does not directly drive the switch 26. A second binary memory 45 is interposed between the binary memory 27 and the gate driving the switch 26. The memory 45 is driven by the specific signal conveyed over the additional row conductor 42.

Figure 12:
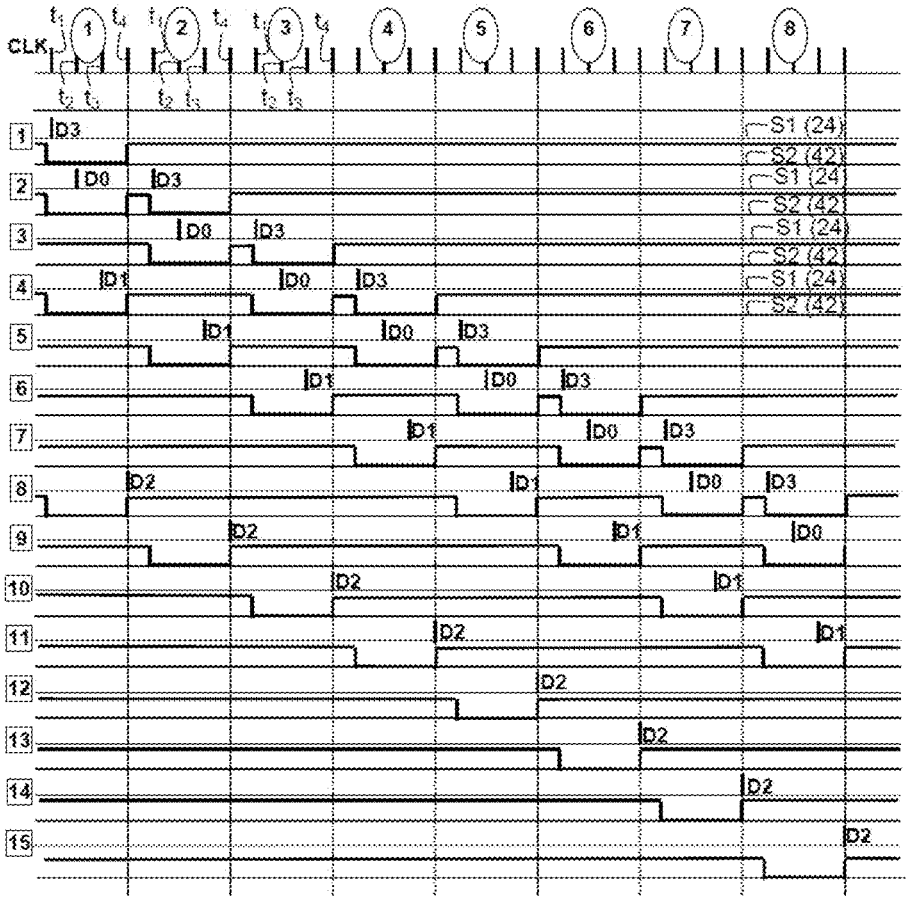
FIG. 12 represents a variant timing diagram suited to the pixels of FIGS. 11*a* and 11*b;*

FIG. 12 represents, in timing diagram form, the signals conveyed over the row conductors 24 and 42. As previously in FIGS. 8, 9 and 10, the time axis bears the different matrix write periods. To simplify understanding, a four-bit brightness resolution has been retained. The timing diagram of FIG. 12 reprises the natural scheduling of the writing of the different brightness bits, the scheduling presented in FIGS. 8*a* and 8*b*. For each of the 15 rows of the matrix, two signals S1 and S2 are represented, the signal S1 conveyed by the conductor 24 and the signal S2 by the conductor 42. The signals S1 conveyed by the different conductors 24 are identical to those described using FIG. 8*a*.

During the first period, and more specifically on the first pip $t_1$, the bit D3 of the first row is written. This bit is conveyed by the column conductor 23 and the pip $t_1$ forms the signal S1 conveyed by the conductor 24 of the first row. For the signal S2 conveyed by the conductor 42, a rising edge enables the content of the memory 27, or the voltage present in the capacitor 21, to drive the switch 26. The passing or blocked state of the switch 26 is maintained as long as a new rising edge does not appear on the conductor 42. To avoid disturbing the driving of the switch 26 due to the writing in the memory 27 (or on the capacitor 21), a falling edge appears on the signal S2 at the start of the first period a little before the appearance of the bit D3 at the pip $t_1$.

For the second row, the bit D0 is written at the pip $t_2$ of the first period and the bit D3 is written at the pip $t_1$ of the second period. For the signal S2 of this second row, a first rising edge occurs at the end of the first period allowing the activation of the diode 25 by the value of the bit D0. A second rising edge occurs at the end of the second period allowing the activation of the diode 25 by the value of the bit D3. The diode has been activated by the bit D0 for exactly one period.

The signals S1 and S2 of the third row are time-shifted by a period relative to the signals of the second row.

For the fourth row, the bit D1 is written at the pip $t_3$ of the first period and the bit D0 is written at the pip $t_2$ of the third period. For the signal S2 of this second row, a first rising edge occurs at the end of the first period allowing the activation of the diode 25 by the value of the bit D1. A second rising edge occurs at the end of the third period allowing the activation of the diode 25 by the value of the bit D3. The diode 25 has been activated by the bit D1 for exactly two periods separating the two rising edges occurring at the end of the first period and the end of the third period. And so on for the different bits D0 which activate the diode 25 for one period, the bits D1 for two periods, the bits D2 for four periods and the bits D3 for eight periods. More generally, the bits of weight j activate the display component for $2^j$ periods.

The pixels 11*d* and 11*e* and the associated timing diagram represented in FIG. 12 refer to a diode 25. Obviously, these variants can be implemented for any other type of display component, such as, for example, a liquid crystal cell or a micro-mirror.

The method described above has a limitation in the existence of a link between the number N of rows of the matrix and the number P of resolution bits of the binary word representing the brightness. More specifically: $N=2^P-1$. For example, a resolution of eight bits imposes a matrix of 255 rows and a resolution of 10 bits imposes a matrix of 1023 rows.

It is possible to exceed this limitation, for example in order to address a matrix having a number of rows twice what the preceding link imposes, for example 510 rows for a resolution of 8 bits. A first solution consists in artificially increasing by one unit the number of bits by systematically assigning a zero to the new least significant bit LSB. This solution can also be implemented in order to multiply the number of rows by any power of two. For example, to quadruple the number of rows, two additional bits can be added.

Figure 13:
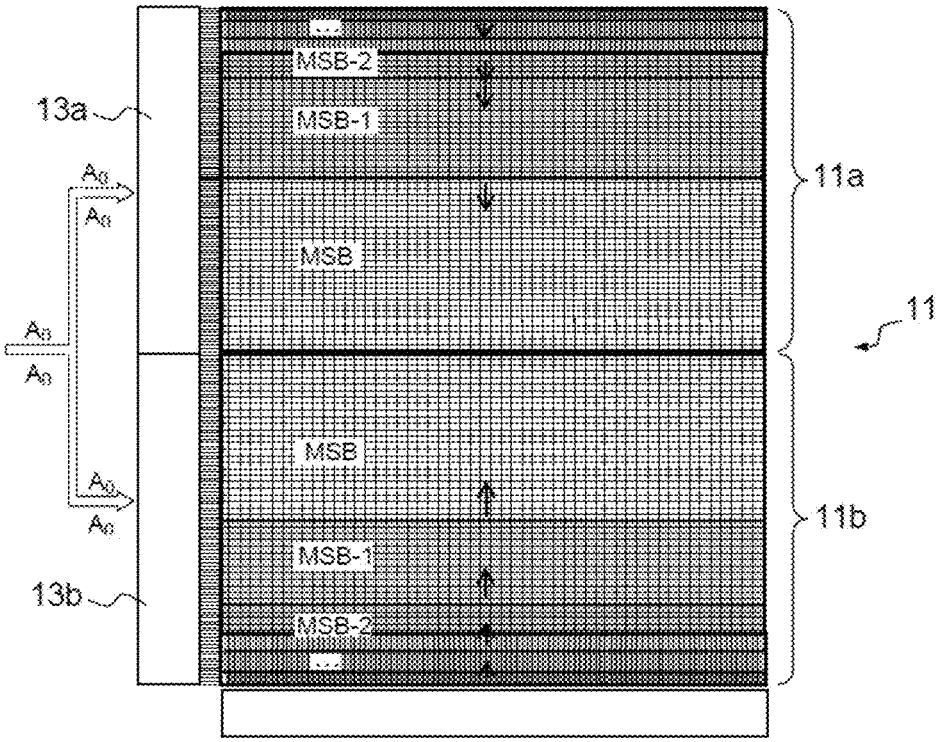
FIGS. 13 and 14 illustrate the implementation of the method of the invention with any matrix format.

FIG. 13 proposes an alternative to the addition of a least significant bit. More specifically, the row addressing circuit is duplicated and each circuit operates separately. In FIG. 13, two row addressing circuits 13*a* and 13*b* are represented, each addressing a half of the matrix 11. More generally, the matrix 11 is divided into areas, 11*a* and 11*b* in the example represented, each of the areas having a number of rows less than or equal to $2^P-1$. Here too, it is possible to multiply the number of row addressing circuits by any integer number.

The video formats that are widely used rarely have numbers of rows corresponding to powers of two. It is nevertheless possible to implement the method of the invention for any format. To this end, to overcome this constraint, it is possible to choose a number of rows $2^P-1$, addressed by the method of the invention, greater the real number of rows of the matrix. Over and above the real rows, the remaining addressed rows will be virtual by assigning them a nil brightness value.

Figure 14:
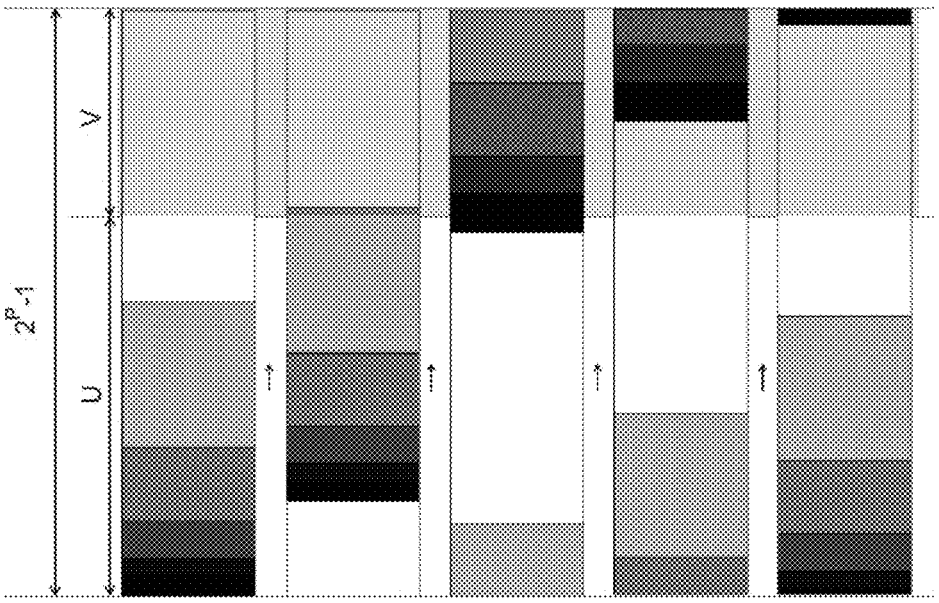

FIG. 14 describes the implementation of such virtual rows. A number of periods are represented therein in a manner similar to the representation of FIG. 3 or 4. The total number of rows addressed $2^P-1$ is represented on a y axis. The number of real rows U of the matrix is equal to $(2^P-1)-V$, V representing the number of remaining virtual rows addressed and whose brightness value is advantageously nil.

The virtual row implementation principal can of course be combined with the multiplication of the number of rows described above. This makes it possible to use the method of the invention without any limitation on the number of real rows of the matrix, whether this number is less than or greater than $2^P-1$.

The invention claimed is:

1. A method for displaying images on a matrix screen comprising a number of rows of pixels, the rows being ordered from i=1 to i=N, i representing a pointer of a current row and N the number of rows, each pixel comprising a display component and a memory, the matrix screen comprising an addressing device for each of the rows and a data transfer device to the memory of each of the pixels, the method consisting in controlling a brightness of each of the pixels of the matrix screen with a binary word comprising a number of bits written successively through the data transfer device, into the memory and by controlling the display component as a function of a state of the bit written into the memory, the bits of each binary word being ranked according to their weight from j=1 to j=P, with P equal to the number of brightness bits, the method comprises sequencing the following writes for a duration of an image frame:

from a current row i, during a period $T_i$, writing on the rows $i-2^j$, from j=1 to j=P, the bit of weight j of each binary word associated with different pixels of the rows $i+2^j$;

successively repeating, $2^P-1$ times, the periods $T_i$ without temporal overlap, the writes mentioned above by shifting the pointer i of the current row by one unit on each repetition;

the rank of the pointer i of a row being determined modulo $2^P-1$ so as to lie between 1 and $2^P-1$, wherein the duration of the period Ti is equal to the duration of an image frame divided by 2P−1.

2. The method according to claim 1, wherein, for each current row i, the writes performed on the rows $i-2^j$ occupy the period $T_i$, and wherein the $2^P-1$ periods $T_i$ have equal durations.

3. The method according to claim 1, wherein each of the pixels further comprises a switch to control the display component as a function of a state of the bit written into the memory and wherein, for each of the pixels, the switch is actuated to drive the display component as a function of the bit written into the memory for a duration extending between two successive writes.

4. The method according to claim 1, comprising, for each of the pixels, activating the display component after writing in the corresponding memory, wherein the writes on the rows $i-2^j$ performed from the current row i are performed during a period, and wherein the display component is activated for a duration extending from the end of the period during which the brightness bit was written to the end of the next period during which a new write is performed in the pixel concerned.

5. The method according to claim 4, wherein the memory of each pixel is called first memory, wherein each pixel comprises a second binary memory to pass the bit written in the first memory to the display component to activate it, wherein the addressing device drive the first memory by a write-enabling first signal and drive the second memory by a second signal distinct from the first signal and to activate the display component.

6. The method according to claim 1, wherein, if the brightness is expressed as a number of R useful bits and the number of rows N is greater than $2^R-1$, then the binary word has added to it a number T of bits whose values are equal to zero, corresponding to a switching off of the display components so that N is less than or equal to $2^P-1$ with P=R+T.

7. The method according to claim 1, wherein, if the brightness is expressed as a number of S useful bits and the number of rows N is greater than $2^S-1$, the matrix is divided into areas driven separately, each of the areas having a number of rows less than or equal to $2^S-1$.

8. The method according to claim 1, wherein, if the matrix comprises a number of useful rows U less than $2^P-1$, then the distribution of the writes is configured to sequence the writes on N rows with $N=2^P-1$ with U useful rows and V virtual rows with U+V=N, and wherein, for the virtual rows, the binary word contains only bits of a value corresponding to a switching off of the display component.

9. The method according to claim 1, wherein, for each given current row i, the writes on the rows $i-2^j$, from j=1 to j=P, of the different bits are ordered to minimize an error over a desired duration separating two successive writes of a same pixel.

10. The method according to claim 1, wherein, for each given current row i, the writes on the rows $i+2^j$, from j=1 to j=P, of the different bits are performed for a duration less than the duration of a period equal to the duration of a frame divided by the number of rows written $2^P-1$.

* * * * *